US008022986B2

(12) United States Patent
Jekel

(10) Patent No.: US 8,022,986 B2
(45) Date of Patent: Sep. 20, 2011

(54) METHOD AND APPARATUS FOR MEASURING WEAPON POINTING ANGLES

(75) Inventor: Richard N. Jekel, Spring Valley, CA (US)

(73) Assignee: Cubic Corporation, San Diego, CA (US)

( * ) Notice: Subject to any disclaimer, the term of this patent is extended or adjusted under 35 U.S.C. 154(b) by 0 days.

(21) Appl. No.: 12/780,789

(22) Filed: May 14, 2010

(65) Prior Publication Data

US 2010/0295942 A1 Nov. 25, 2010

Related U.S. Application Data

(60) Provisional application No. 61/179,664, filed on May 19, 2009.

(51) Int. Cl.
*H04N 7/18* (2006.01)
*F41G 3/26* (2006.01)

(52) U.S. Cl. ..... 348/139; 434/19

(58) Field of Classification Search ..... 348/139; 250/221, 203, 227.12, 390.11; 463/37, 51; 434/16, 19, 21, 22, 11
See application file for complete search history.

(56) References Cited

U.S. PATENT DOCUMENTS

| | | | | |
|---|---|---|---|---|
| 5,477,459 | A | 12/1995 | Clegg et al. | |
| 5,675,112 | A | 10/1997 | Giry et al. | |
| 7,421,093 | B2 | 9/2008 | Hildreth et al. | |
| 7,496,241 | B1 | 2/2009 | Reneker et al. | |
| 2005/0187677 | A1 * | 8/2005 | Walker | 701/16 |
| 2006/0097882 | A1 * | 5/2006 | Brinkerhoff et al. | 340/573.2 |
| 2007/0254266 | A1 * | 11/2007 | Galanis et al. | 434/21 |
| 2009/0040308 | A1 * | 2/2009 | Temovskiy | 348/158 |
| 2009/0079616 | A1 * | 3/2009 | Daum | 342/45 |
| 2009/0081619 | A1 * | 3/2009 | Miasnik | 434/21 |
| 2010/0092925 | A1 * | 4/2010 | Lvovskiy et al. | 434/22 |

OTHER PUBLICATIONS

The two photos show an Extravehicular Visor Assembly (EVA) that fits over a helmet of a space suit. The EVA includes at least one camera, and may include as many as three digital cameras, although this could not be verified. The attached article "How Space Suits Work" describes the EVA as including "A TV camera" and four head lamps. May 2009.

Freudenrich, Craig, "How Space Suits Work", obtained online on Aug. 17, 2010 at http://howstuffworks.com/space-suit5.htm, 3 pages.

* cited by examiner

*Primary Examiner* — Behrooz Senfi
(74) *Attorney, Agent, or Firm* — Kilpatrick Townsend & Stockton LLP

(57) ABSTRACT

A weapon orientation measuring device in accordance with the disclosure includes a processor configured to receive first location information indicative of locations of a first point and a second point on a weapon, the first and second points being a known distance apart in a direction parallel to a pointing axis of the weapon, and to receive second location information indicative of the locations of the first and second points on the weapon. The processor is further configured to receive information indicative of a first earth orientation, and determine a second earth orientation corresponding to the weapon based on the first and second location information and the information indicative of the first earth orientation. The first location information represents location relative to a first sensor at a first location and the second location information represents location relative to a second sensor at a second location, and the first and second sensors are separated by a given distance.

20 Claims, 11 Drawing Sheets

METHOD AND APPARATUS FOR MEASURING WEAPON POINTING ANGLES

This application claims the benefit of U.S. Provisional Application No. 61/179,664, filed May 19, 2009, entitled "Method and Apparatus for Measuring Weapon Pointing Angles," which is incorporated herein by reference for all purposes.

BACKGROUND

The Multiple Integrated Laser Engagement System (MILES) is a modern, realistic force-on-force training system. An exemplary MILES system is the MILES 2000® system produced by Cubic Defense Systems, Inc. As a standard for direct-fire tactical engagement simulation, MILES 2000 is used by the United States Army, Marine Corps, and Air Force. MILES 2000 has also been adopted by international forces such as NATO, the United Kingdom Ministry of Defense, the Royal Netherlands Marine Corps, and the Kuwait Land Forces.

MILES 2000 includes wearable systems for individual soldiers and marines as well as devices for use with combat vehicles (including pyrotechnic devices), personnel carriers, antitank weapons, and pop-up and stand-alone targets. The MILES 2000 laser-based system allows troops to fire infrared "bullets" from the same weapons and vehicles that they would use in actual combat. These simulated combat events produce realistic audio/visual effects and casualties, identified as a "hit," "miss," or "kill." The events may be recorded, replayed and analyzed in detail during After Action Reviews which give commanders and participants an opportunity to review their performance during the training exercise. Unique player ID codes and Global Positioning System (GPS) technology ensure accurate data collection, including casualty assessments and participant positioning.

MILES systems may some day be phased out. One possible system that may replace MILES is the One Tactical Engagement Simulation System (OneTESS) currently being studied by the U.S. Army. Every aspect of the OneTESS design focuses on being engagement-centric, meaning that target-shooter pairings (often referred to as geometric pairings) need to be determined. In other words, the OneTESS system will need to predict, after a player fires a weapon, what the target is and whether or not a hit or miss results when a player activates (e.g. shoots) a weapon. In order to establish target-shooter pairings, the OneTESS system needs to determine what the intended target was and whether or not a hit or miss occurred, both of which depend on the orientation of the weapon, and other factors (e.g., weapon type, type of ammunition, etc.). Accurate determinations of the target-shooter pairings and accurate determinations of hit or miss decisions depend on the accuracy in which the orientation of the weapon at the time of firing can be determined.

SUMMARY

In one embodiment, weapon orientation measuring device is disclosed. The weapon orientation measuring device includes a processor. The processor receives first location information indicative of locations of a first point and a second point on a weapon. The first and second points are a known distance apart in a direction parallel to a pointing axis of the weapon. The processor receives second location information indicative of the locations of the two points on the weapon and receives information indicative of a first earth orientation. The processor determines a second earth orientation corresponding to the weapon based on the first and second location information and the information indicative of the first earth orientation. The first location information represents location relative to a first sensor at a first location and the second location information represents location relative to a second sensor at a second location. The first and second sensors are separated by a given distance.

In another embodiment, a method of determining an orientation of a weapon includes receiving first location information indicative of locations of a first point and a second point on a weapon, where the first and second points are a known distance apart in a direction parallel to a pointing axis of the weapon. The method further includes receiving second location information indicative of the locations of the two points on the weapon, receiving information indicative of a first earth orientation, and determining a second earth orientation corresponding to the weapon based on the first and second location information and the information indicative of the first earth orientation. The first location information represents location relative to a first sensor at a first location and the second location information represents location relative to a second sensor at a second location. The first and second sensors are separated by a given distance.

In yet another embodiment, a weapon orientation measuring system is disclosed. The system includes a first emitter configured to generate a first output signal, the first emitter being located at a first point on a weapon. The system further includes a second emitter configured to generate a second output signal, the second emitter being located at a second point on the weapon. The first and second points are a known distance apart in a direction parallel to a pointing axis of the weapon. The system further includes a first sensor configured to receive the first and second output signals and to generate first information indicative of first relative locations of the first and second points on the weapon relative to the first sensor, and a second sensor configured to receive the first and second output signals and to generate second information indicative of second relative locations of the first and second points on the weapon relative to the second sensor. The first and second sensors are separated by a given distance. The system further includes an earth orientation device configured to generate information indicative of a first earth orientation, and a communication subsystem configured to transmit weapon orientation information indicative of an earth orientation of the weapon toward a data center remote from the weapon. The weapon orientation information is determined based on the first and second relative locations and the first earth orientation.

Items and/or techniques described herein may provide one or more of the following capabilities. Instruments that are sensitive to magnetic fields or sensitive to the shock experienced by the firing of a weapon can be located away from the barrel of the weapon, where both the shock and weapon's magnetic field are greatly reduced, thus improving the performance of the weapon orientation measurement system. Earth orientation can be greatly enhanced using a miniature optical sky sensor mounted away from the barrel of the weapon (e.g., on a helmet or a portion of a vehicle) to provide azimuth angles with greatly enhanced accuracy when the sun or stars are visible. The improved accuracy of the weapon orientation and earth orientation measurements can result in greater accuracy in determining the earth orientation of the weapon. A remote data center or parent system can wirelessly receive the weapon orientation measurements to accurately score a firing of the weapon from the shooter to a target.

Figure 1:
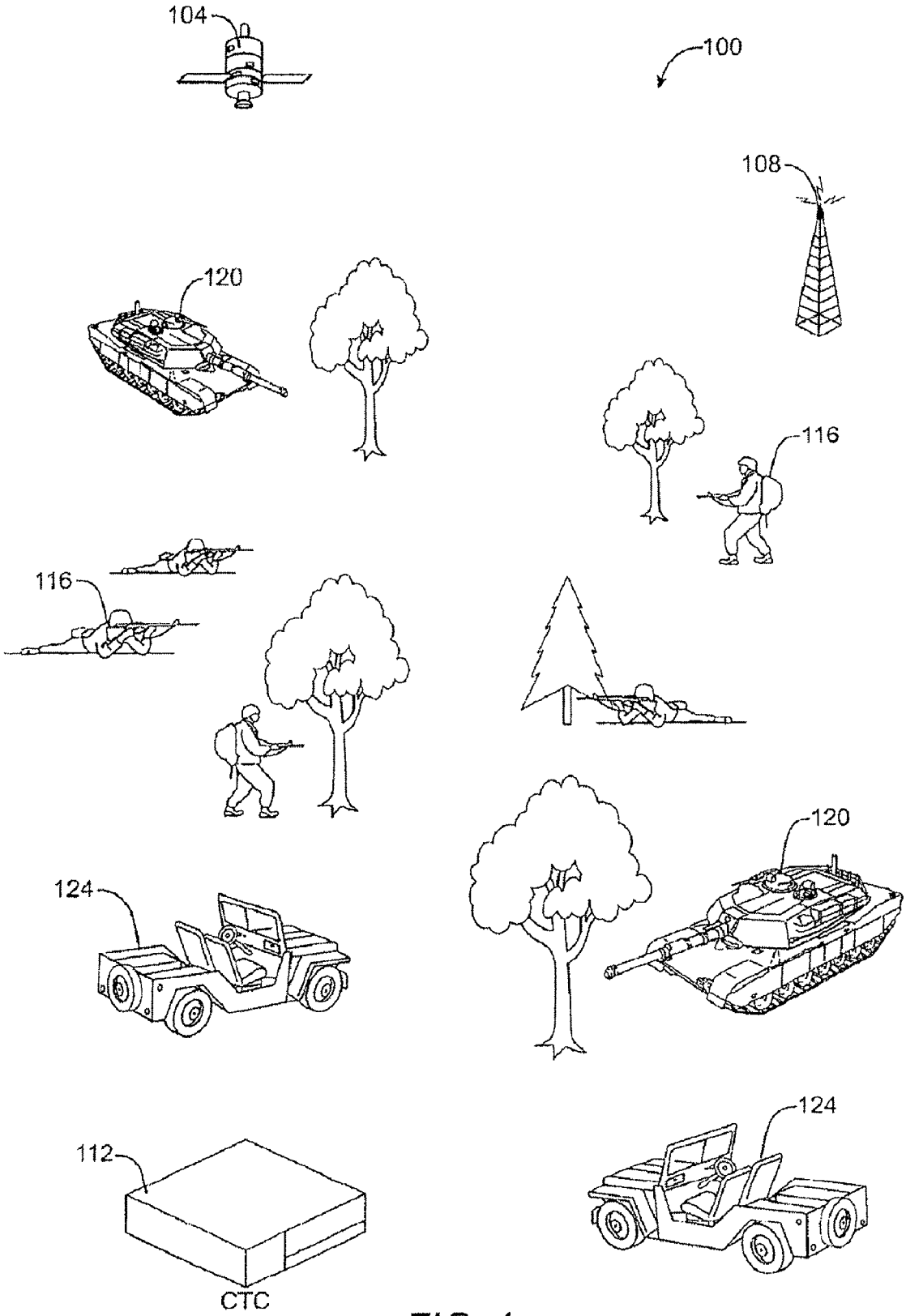
FIG. 1 depicts a combat training exercise in which manworn and vehicle mounted weapons orientation systems in accordance with the disclosure are utilized.

The features, objects, and advantages of embodiments of the disclosure will become more apparent from the detailed description set forth below when taken in conjunction with the drawings. In the drawings, like elements bear like reference labels. Various components of the same type may be distinguished by following the reference label with a dash and a second label that distinguishes among the similar components. If only the first reference label is used in the specification, the description is applicable to any one of the similar components having the same first reference label irrespective of the second reference label.

DETAILED DESCRIPTION

Orientation measurement systems typically rely on instruments that are sensitive to gravitational and magnetic fields (e.g., accelerometers, gyros, megnetometers, etc.). Since weapons are generally made of ferrous metals, they have residual magnetic fields that may be strong compared to the Earth's magnetic field. Even though orientation sensors may be calibrated for a particular weapon, the magnetic fields of a weapon have been observed to change slightly after each time the weapon is fired. This makes orientation sensors that include sensors that are sensitive to magnetic fields less accurate for measuring the orientation of a weapon. In addition, magnetic or other types of orientation sensors tend to be sensitive to the shock of a weapon being fired, which also makes them less accurate for measuring the orientation of a weapon. Systems and methods disclosed herein remove the orientation sensing equipment away from the weapon and thereby provide a more stable and accurate weapon orientation measuring system. In one embodiment, digital cameras are mounted on an orientation platform away from the weapon. The digital cameras capture images of point emitters positioned at known locations along an axis parallel to the barrel of the weapon. Using earth orientation measurements obtained from a measurement device on the orientation platform, the locations of the point emitters as captured by the digital cameras are translated to an earth-centric coordinate system. The earth-centric weapon orientations are then transmitted to a remote data center where a location of a desired target can be determined and a hit-miss determination can be made. The orientation platform can be, for example, a helmet of a soldier, a portion of a combat vehicle, or some other platform located at a known location relative to the weapon.

FIG. 1 depicts a combat training exercise 100 in which manworn and vehicle mounted simulation systems utilizing embodiments of a weapon orientation system in accordance with the disclosure may be utilized. GPS satellite 104 provides location and positioning data for each participant in combat training exercise 100. Data link 108 relays this information to combat training center (CTC) 112. Combat training center 112 is a place where real-time information about the training exercise is collected and analyzed. Combat training center 112 may also communicate tactical instructions and data to participants in the combat training exercise through data link 108.

A weapon orientation detection system is associated with each soldier 116 and vehicle 120, 124 in the training exercise. The weapon orientation detection system determines the orientation of the weapon at the time a weapon is fired. The manworn and vehicle mounted simulation systems combine the orientation information with information that uniquely identifies the soldier 116 or vehicle 120, 124, and the time of firing and communicate the combined information to the combat training center 112 via the data link 108. The weapon orientation detection system may communicate with one or more GPS satellites 104 to provide location and positioning data to the combat training center 112. Other information that the weapon orientation detection system can communicate to the combat training center 112 includes weapon type and ammunition type.

Using the information transmitted from the manworn and vehicle mounted simulation systems, the computer systems at the combat training center 112 determines target-shooter pairings and determines the result of the simulated weapons firing (e.g., a hit or a miss). The combat training center 112 systems can take into account terrain effects, building structure blocking shots, weather conditions, target posture (e.g., standing, kneeling, prone) and other factors in making these determinations.

Figure 2A:
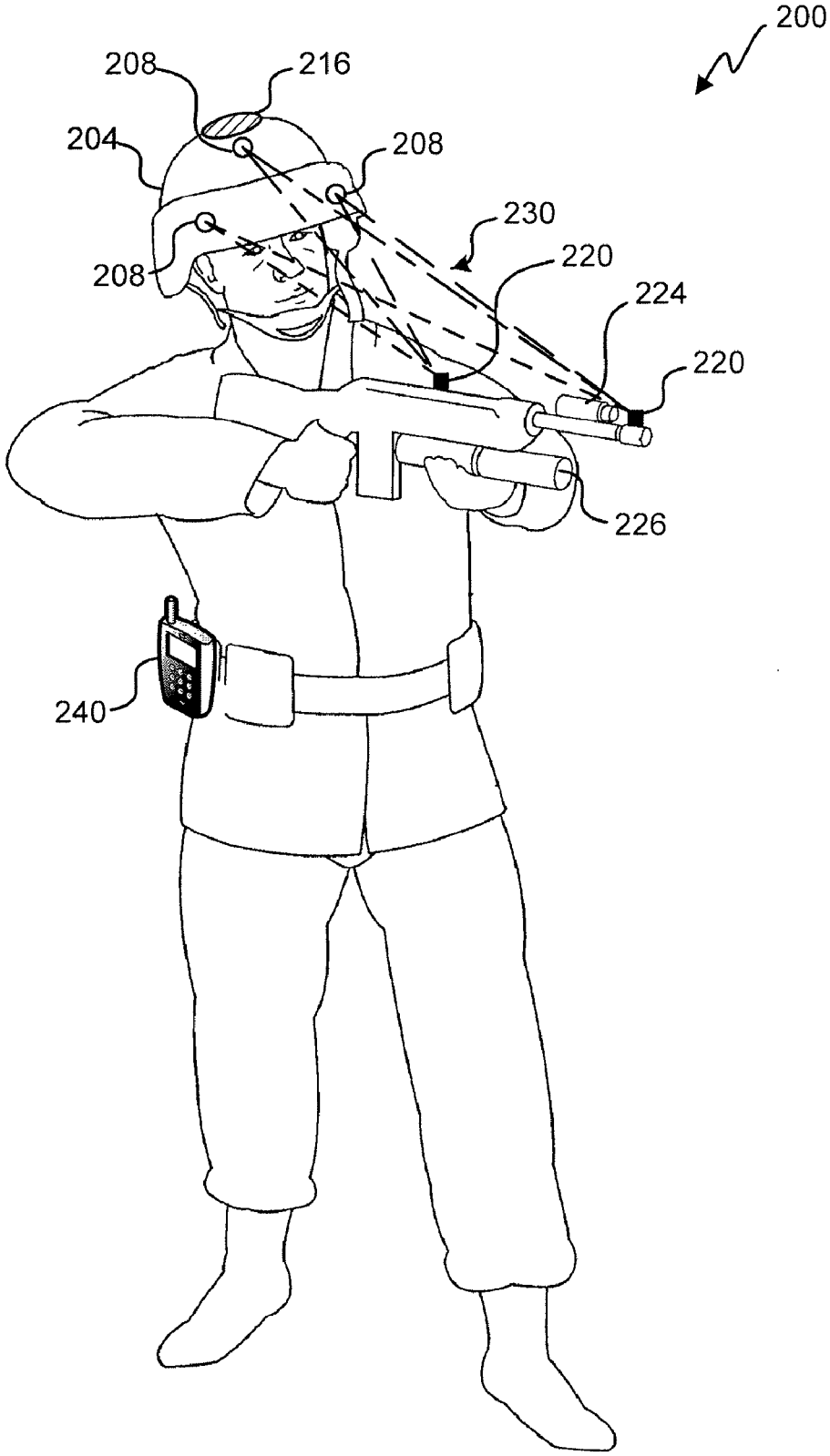
FIGS. 2A, 2B and 2C are manworn embodiments of a wireless weapon orientation system in accordance with the disclosure.

FIG. 2A is a manworn embodiment 200 of a weapon orientation system in accordance with the disclosure. A soldier is shown with a helmet 204 outfitted with three digital cameras 208 and a helmet mounted orientation platform 216. The soldier is holding a gun 218 that is outfitted with two point emitters 220, and, in this embodiment, a small-arms transmitter (SAT) 224. In some embodiments, the SAT 224 can be replaced by a device that does not emit an IR signal. The soldier is also equipped with a communication subsystem 240. In this embodiment, the digital cameras 208, the orientation platform 216, the point emitters 220, the SAT 224 and the communication subsystem 240 are not physically connected. Instead, each component can exchange messages as part of a wireless personal area network (PAN).

The digital cameras 208 capture images of the point emitters 220. The digital cameras 208 are equipped with lens systems that provide a field of coverage that is adequate to be able to capture images of both the point emitters 220 for most common firing positions that the soldier utilizes. Lines of sight 230 illustrate exemplary fields of vision that the lens systems of the digital cameras 208 can encounter in a firing situation. The point emitters 220 can be infrared (IR) sources, such as, for example, light-emitting diodes (LED) or fiber optics tipped with diffusers. The point emitters 220 can be positioned so as to determine a line parallel to a bore of the gun 218. The point emitters 220 are disposed to shine toward the soldier's face and helmet 204.

The digital cameras 208 are miniature digital cameras mounted rigidly on the helmet 204 so that they face forward. For example, by characterizing the camera magnification, camera orientation, and any barrel or pin-cushion distortion of the digital cameras 208, etc., the views captured by the three digital cameras 208 of the two point emitters 220 can provide a good estimate of the orientation of the gun 218 relative to the helmet. The orientation platform 216 provides orientation angles of the helmet in an earth-centric coordinate system. Using the knowledge of the helmet's pitch, roll, and yaw angles in the earth-centric coordinate system, a rotation in three dimensions will translate the weapon's orientation from helmet-referenced to local North-referenced azimuth and elevation.

The orientation angles and earth location of the gun 220 can be transmitted by the communication subsystem 240 to a remote data center (e.g., the combat training center 112 of FIG. 1) in order for geometric pairing to be performed. Other information, such as, for example, weapon type, ammunition type, soldier identification and weapon activation time can also be transmitted to the remote data center.

The manworn weapon orientation system 200 includes miniature IR digital cameras 208 and infrared (IR) point emitters 220. The IR point emitters 220 can be light emitting diodes, or the ends of two optical fibers, with suitable diffusers. The point emitters 220 are arranged so that they define a line parallel to the bore axis of the gun 218. The digital cameras 218 can be fitted with narrowband wavelength filters so as not to respond to visible light. The digital cameras 208 are mounted rigidly on the helmet, and the image processing system and weapon orientation calculations performed by the orientation platform 216 are calibrated as to scale factor, angular orientation, and distortions such as barrel or pincushion distortion of the digital cameras 208.

In the embodiment of FIG. 2A, the point emitters 220 are not visible to the naked eye since they are IR emitters. In this way, they do not interfere with the vision of the soldier. In some embodiments, the point emitters 220 emit a wavelength of light that is also not visible using night vision goggles. For example, an IR point emitter 220 that emits a wavelength $\lambda$>930 nm could be used. In these embodiments, the digital cameras 208 could use silicon imaging which is sensitive to wavelengths of light up to about $\lambda$=1100 nm.

In some embodiments, the communication subsystem 240 forms the wireless PAN and acts as a central point for receiving messages carried on the network. As shown, communication subsystem 240 is a separate module but it can be integrated with the orientation platform 216. Additional weapons including additional SATs 224 may be added to the PAN to allow different weapons to be fired and respective orientations determined. The SATs 224 of additional weapons include identifying information that the orientation platform 216 can distinguish from other SATs 224 in the PAN in order to correctly calculate the orientation of each weapon. For example, an association process can be performed in which each weapon and SAT 224 is registered and receives addressing information needed to communicate on the personal area network. In some embodiments, an SAT 224 may actively initiate association with the communication subsystem 240 by transmitting an IR signal that includes a random value.

Figure 2B:
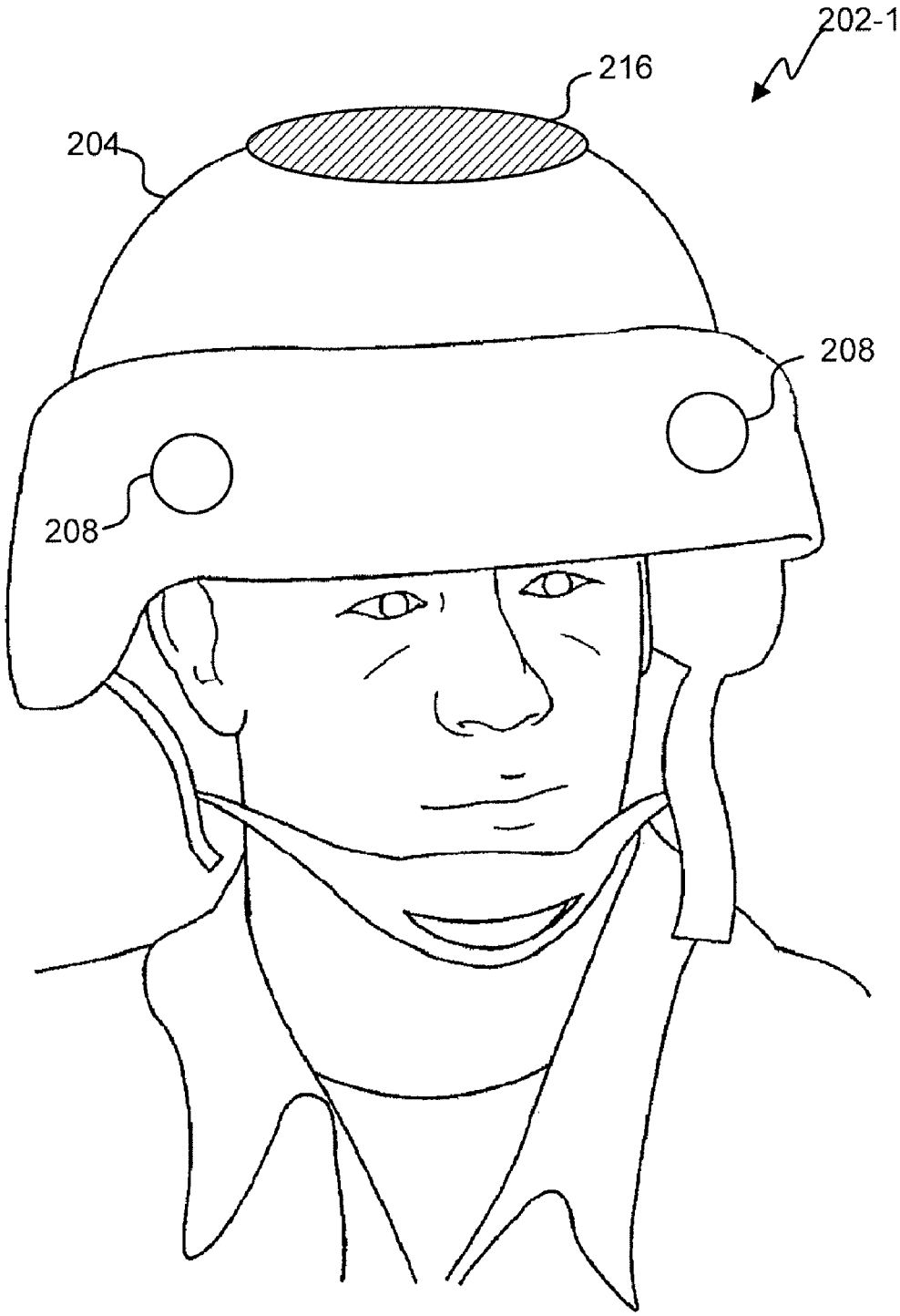
Figure 2C:
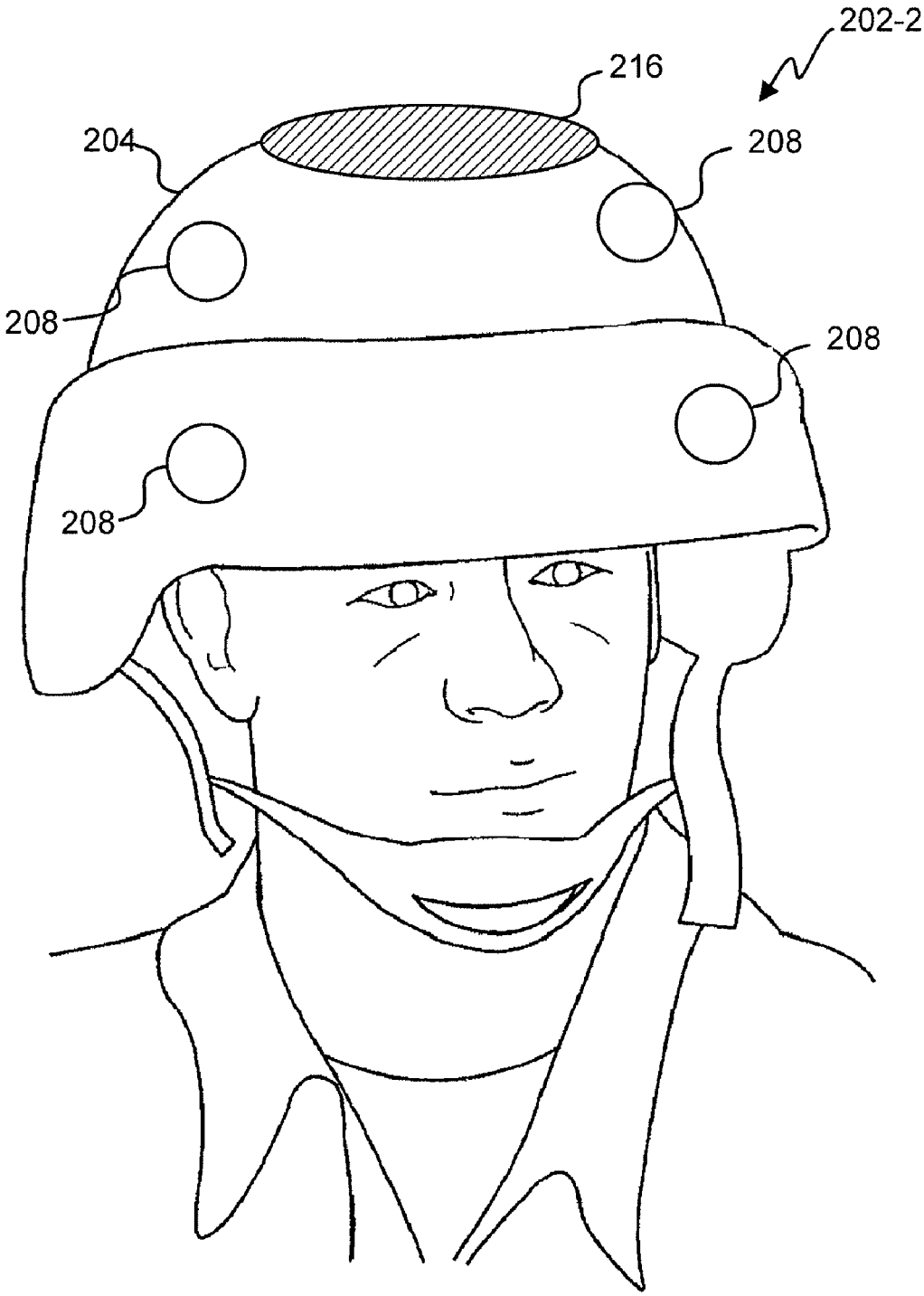

In the manworn weapon orientation system 200, that includes three digital cameras 208, one digital camera 208 is mounted left of the left eye, one to the right of the right eye, and one over the center of the forehead. Although it is possible to produce a solution with only two cameras, three are used in the manworn weapon orientation system 200 such that (1) if one camera's view of the point emitters 220 is obstructed, a solution is still possible, and (2) when all three have a view of the point emitters 220, which is the ordinary situation, there is redundancy that improves the accuracy of measurement. FIGS. 2B and 2C show manworn weapon orientation systems 202-1 and 202-2 that include two and four digital cameras 208, respectively.

Figure 3:
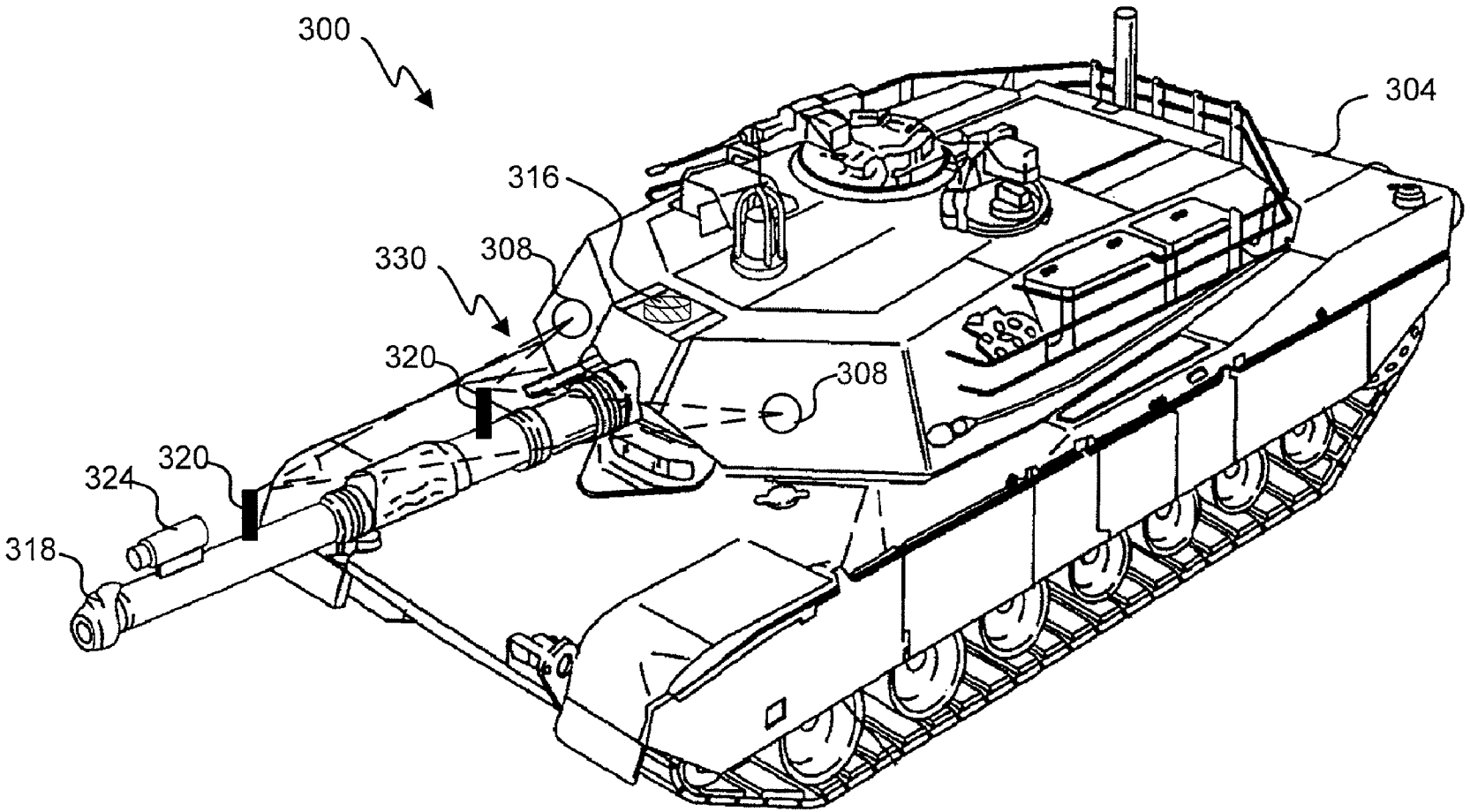
FIG. 3 is a vehicle-mounted embodiment of a wireless weapon orientation system in accordance with the disclosure.

FIG. 3 is a vehicle-mounted embodiment 300 of a wireless weapon orientation system. In this embodiment, two digital cameras 308 and an orientation platform 316 are mounted on a combat vehicle 304. In addition, two point emitters 320 and a vehicle mounted weapon transmitter 324 (similar to the SAT 224) are mounted on a barrel of a turret gun 318. Vehicle mounted digital cameras 308 and point emitters 320 can be larger than their manworn counterparts and may also be equipped with fastening means to simplify attachment to a vehicle's exterior. Similar to manworn embodiments, vehicle-mounted digital cameras 308 communicate wirelessly with the orientation platform 316 over a PAN comprising the various parts of the vehicle-mounted system. In this embodiment, a communication subsystem for communication with an outside network is integrated in the orientation platform 316, but the communication system could be a separate subsystem located elsewhere on the combat vehicle 304. The vehicle weapon orientation system 300 includes two digital cameras 308, but other embodiments can use three, four, or more digital cameras 308.

Figure 4:
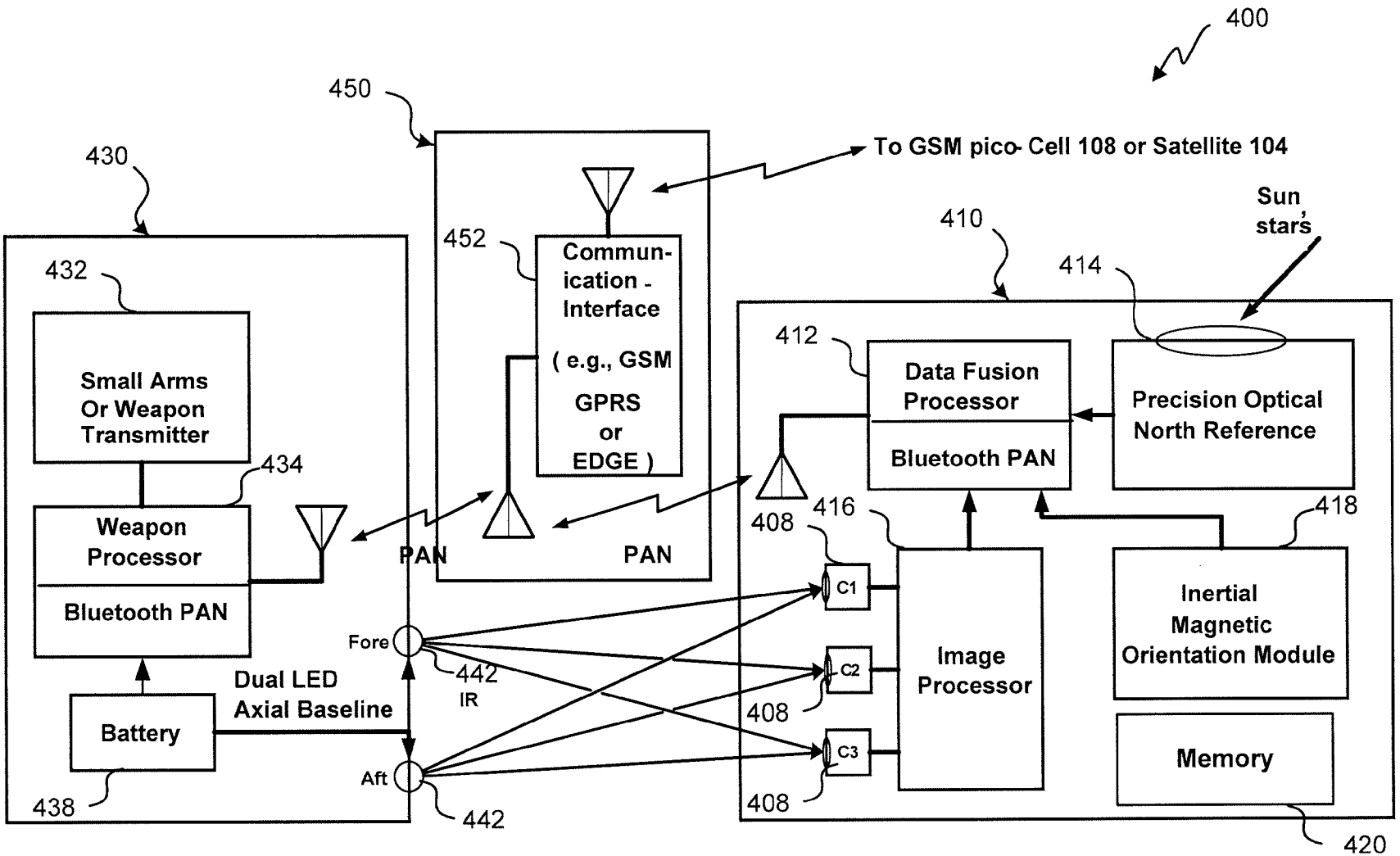
FIG. 4 is a functional block diagram of an embodiment of a weapon orientation system in accordance with the disclosure.

With reference to FIG. 4, a weapon orientation system 400 includes an orientation platform subsystem 410, a weapon mounted subsystem 430 and a communication subsystem 450. The orientation platform subsystem 410 can be part of a manworn weapon orientation system such as the portions of the system 200 of FIG. 2A that are mounted on the helmet 204. The orientation platform subsystem 410 can also be part of a vehicle mounted weapon orientation system such as the portions of the system 300 of FIG. 2A that are mounted on the combat vehicle 304 away from the turret gun 318. The weapon mounted subsystem 430 can be mounted on the gun 218 or the turret 318 when used in the manworn system 220 or the vehicle mounted system 320, respectively. The communication subsystem 450 can reside in the communication subsystem 240, or be integrated in either the helmet mounted orientation platform 216 or the vehicle mounted orientation platform 316.

The orientation subsystem 410, weapon mounted subsystem 430 and communication subsystem 450 are linked wirelessly via a PAN. The PAN can use any of several wireless protocols including Bluetooth, WiFi (802.11), and 802-15 (e.g., 802.15.4 commonly referred to as WPAN (Wireless Personal Area Network) including Dust, ArchRock, and ZigBee). Other embodiments could use optical data communication for the PAN.

The orientation platform subsystem 410 includes a plurality of digital cameras 408, a data fusion processor 412, an earth orientation reference 414, an image processor 416, an inertial/magnetic orientation module 418 and memory 420. The digital cameras 408 can be IR digital cameras such as the digital cameras 208 and 308 of FIGS. 2A-C and 3. In other embodiments, other types of digital cameras can be used. Three digital cameras 408 are shown, but other numbers of cameras, such as two, four or more, could also be used. The cameras 408 are mounted on the orientation platform subsystem 410 such that two point emitters 442 mounted on the weapon subsystem 430 are in the fields of view of the digital cameras 408.

The image processor 416 receives the output images from the digital cameras 408. The output images contain images of the point emitters 442. The image processor 416 performs pattern recognition or some other image identification process to locate the point emitters 442 in the fields of view of the digital cameras 408. The image processor then forwards coordinates of the point emitters 442 to the data fusion processor 412. In some embodiments, the image processor 416 performs an averaging technique, such as a centroid calculation, to identify the centermost pixel or fraction of a pixel where each of the point emitters is located.

The data fusion processor 412 can be one or more application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, other electronic units designed to perform the functions described herein, and/or a combination thereof. In this embodiment, the data fusion processor 412 includes an integrated Bluetooth PAN module. Alternatively, a separate PAN module could be included in the orientation platform subsystem 410.

The data fusion processor 412 receives various inputs from the other components 414, 416 and 418. The inputs include earth orientation from the inertial/magnetic orientation module 418, earth locations from a GPS module (e.g., included in the communication subsystem 450) and locations of the point emitters 442 from the image processor 416. The data fusion processor 412 processes these inputs to calculate the orientation of the weapon that the weapon mounted subsystem 430 is mounted on. The data fusion processor 412 is coupled to the memory 420. The memory 420 stores information including time-stamped locations of the point emitters 442 and earth orientations of the orientation platform subsystem 410. The memory 420 is shown external to the data fusion processor 412, but memory may be implemented within the data fusion processor 412.

The memory 420 can include one or more of long term, short term, volatile, nonvolatile, or other storage medium and is not to be limited to any particular type of memory or number of memories, or type of media upon which memory is stored. Moreover, a memory can be generally referred to as a "storage medium." As used herein, "storage medium" may represent one or more memories for storing data, including read only memory (ROM), random access memory (RAM), magnetic RAM, core memory, magnetic disk storage mediums, optical storage mediums, flash memory devices and/or other machine readable mediums for storing information.

The memory 420 contains one or more Kalman filter models used by the data fusion processor 412 to calculate the orientation of the weapon(s) upon which the weapon subsystem 430 is mounted. For example, a soldier could have a rifle, a hand gun, a grenade launcher, or any other type of weapon. The memory 420 would contain Kalman filter models for each of these weapons. The data fusion module 412 would retrieve the appropriate model depending on which weapon was fired. The identity of the weapon being fired would be communicated to the data fusion processor 412 by an appropriate weapon mounted subsystem 430.

The earth orientation reference 414 provides an estimate of the Geodetic or True North direction. The magnetic North estimate is used as an earth orientation reference for the orientation platform subsystem 410 (e.g., the orientation of the helmet 204 or the vehicle 304) to the data fusion processor 412. The earth orientation reference 414 includes precision optical devices that locate the position of the sun and/or stars. The earth orientation reference 414 can include a camera that points straight up from the orientation platform to locate positions of the stars and/or sun. Orientation accuracies as fine as 0.1 degrees can be obtained by some optical orientation systems.

The inertial/magnetic orientation module 418 includes directional gyroscopes, accelerometers and magnetometers use to determine the orientation of the orientation platform subsystem 410. The magnetometers provide an estimation of magnetic North. The estimation of the Geodetic or True North reference that is determined by the earth orientation reference 414 is used, when available, to calibrate the relationship between True North and magnetic North and maintain the accuracy of the inertial/magnetic orientation module 418. The data fusion processor 412 relates the magnetic North estimate of the inertial/magnetic orientation module 418 to the True North estimate during calibration. When the True North reference is not available, a previous calibration is used to relate magnetic North to True North. The inertial/magnetic orientation module 418 provides the earth orientation of the orientation platform subsystem 410 periodically to the data fusion processor 412. In some embodiments, the inertial/magnetic orientation module 418 could be integrated into the earth orientation reference 414.

The weapon subsystem 430 includes a weapon transmitter 432. The weapon transmitter 432 can be the SAT 224 or the vehicle mounted weapon transmitter 324 of FIGS. 2A and 3, respectively. The weapon subsystem 430 also includes a weapon processor 434 with an integrated Bluetooth PAN communication subsystem. In some embodiments, a separate PAN subsystem could be used in the weapon subsystem 430. A battery 438 provides power to the other components of the weapon subsystem 430.

The communication subsystem 450 includes a communication interface 452. The communication interface 452 can be a cellular telephone transceiver, a MAN transceiver, a satellite transceiver, or other type of transceiver that communicates over a network to a remote data center. The remote data center could be, for example, the combat training center 112 of FIG. 1 and the communication interface could communicate to the combat training center 112 via the datalink 108 or some other wireless network such as a satellite.

The weapon orientation system 400 can provide very accurate orientation measurements of a variety of weapons. In designing an embodiment of the weapon orientation system 400, one can calculate the geometric dilution of precision (GDOP) of a given weapon system in order to determine potential accuracy of the system. The results of the GDOP analysis can be used to determine the granularity of the digital cameras 408 that will provide satisfactory estimates of weapon orientation. An example GDOP analysis for an example of the manworn weapon orientation system 200 illustrated in FIG. 2A will now be described.

In systems utilizing optical means for determining angle measurements and/or distance measurements, the geometry of the system creates a dilution of precision which relates the accuracy of the measuring equipment to the achievable accuracy of the final measurement of angle and/or position. The GDOP analysis assumes that the digital cameras have a known accuracy and are precisely aligned with regard to scale factor and orientation to the helmet 204. The GDOP analysis provides a quantifiable estimate of the effects that the geometric factors of the weapon system being modeled have on the potential accuracy of the system. In this way, the fundamental measuring accuracy of the cameras and the results of the GDOP analysis jointly set a lower bound on achievable errors. The GDOP analysis described herein initially assumes that the digital cameras 208 can identify the IR spot with standard deviation of one milliradian. The resulting errors in azimuth and elevation (in milliradians) will be the GDOP.

Figure 5:
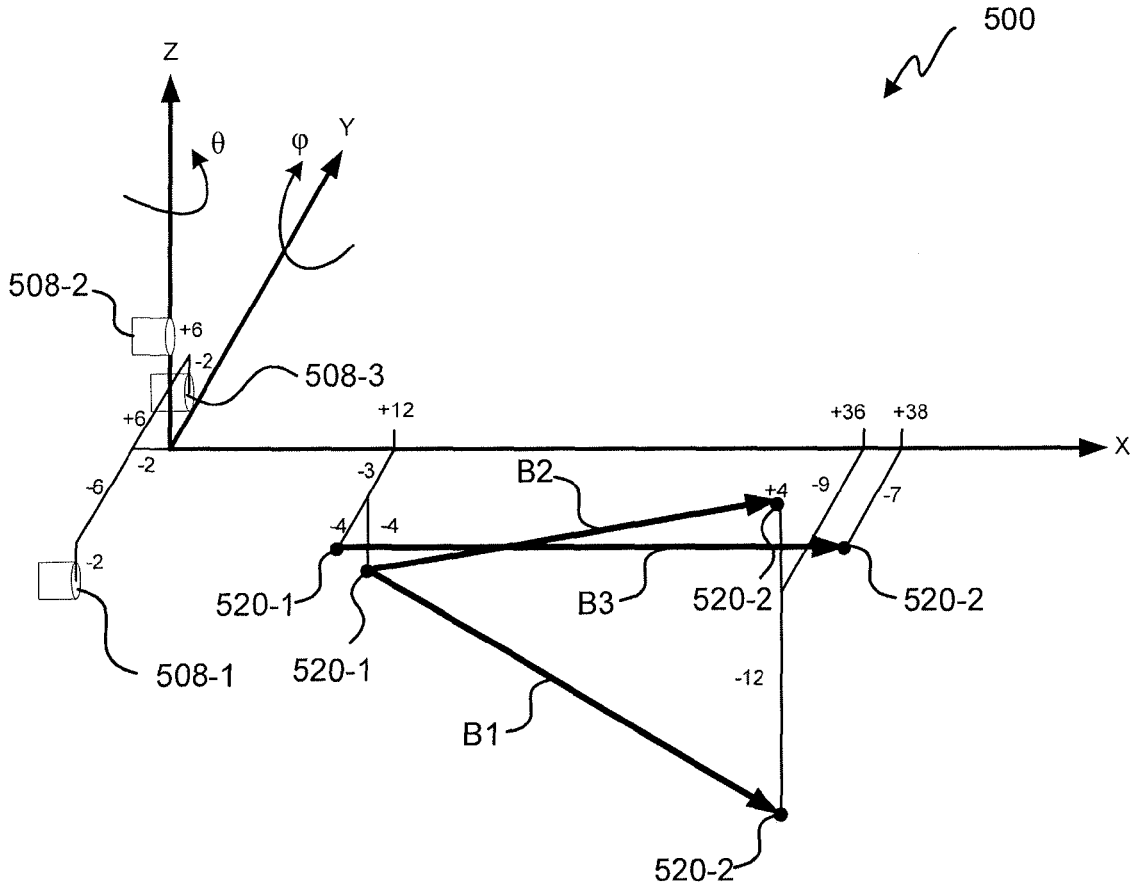
FIG. 5 is a perspective view of a geometric model of an embodiment of a weapon orientation system in accordance with the disclosure.

In reference to FIG. 5, a geometric model 500 corresponding to the manworn weapon orientation system 200 of FIG. 2 is shown. The geometric model 500 approximates a likely geometry so as to evaluate the potential accuracy degradation from geometry. Three digital cameras 508-1, 508-2 and 508-3 are shown. The three digital cameras 508-1, 508-2 and 508-3 correspond to the digital cameras 208 shown in FIG. 2A. Digital camera 508-1 is located outside and above the right eye, 508-2 is located above the center of the forehead and 508-3 is located outside and above the left eye. The (x, y, z) coordinates (in inches) of the digital cameras 508-1, 508-2 and 508-3 that have been assumed for the model 500 are (−2, −6, −2), (−2, 0, 6) and (−2, 6, −2), respectively. The digital cameras 508 are all faced parallel to the X-axis. The origin of the (x, y, z) coordinate system is estimated to be between the soldier's eyes. The digital camera 508-2 is placed with its lens six inches above the soldiers eye. The digital cameras 508-1 and 508-3 are two inches to the rear and two inches below the eye line, and spaced 6 inches to either side of the nose.

Also illustrated in FIG. 5 are an aft point emitter 520-1 and a fore point emitter 520-2. The aft point emitter 520-1 is shown at two locations and the fore point emitter 520-2 is shown at three locations representing test cases considered in the GDOP analysis. Test cases B1, B2 and B3 illustrate the orientation of the weapon in three different orientations. The coordinates of the locations of the aft point emitter 520-1 and the fore point emitter 520-2 for the test cases B1, B2 and B3 are listed in FIG. 5 and are all in inches.

The GDOP analysis models nine test cases in all. The nine test cases model three different locations of the aft and fore point emitters 520-1 and 520-2, respectively, combined with three different weapon orientations. Table 1 below lists the nine test cases B1, B2, B3, B4, B5, B6, B7, B8 and B9. In Table 1, the baseline length refers to the distance between the point emitters 520-1 and 520-2 that are mounted on the weapon and the orientation refers to how the weapon is pointed relative to the cameras 508 mounted on the weapon. The first three test cases, B1, B2, and B3 are illustrated in FIG. 5. B1 is positioned to simulate a weapon on the soldier's right shoulder, pointing downward and to the right. The baseline length is 26 inches. B2 uses the same baseline length, but pointing upward and to the right. B3 is also 26 inches in length, but the weapon points level and straight forward. These are reasonable positions for the weapon. The GDOP analysis includes six more cases, three, B4, B5 and B6, that use the rear 13 inches of each of the 26 inch baselines, and three, B7, B8 and B9, that use the forward 13 inches of the 26 inch baselines.

TABLE 1

| Test Cases | | |
|---|---|---|
| Test Case | Baseline Length | Orientation |
| B1 | Full 26 inches | Aimed Down & Right |
| B2 | Full 26 inches | Aimed Up & Right |
| B3 | Full 26 inches | Aimed Straight Forward |
| B4 | Rear 13 inches | Aimed Down & Right |
| B5 | Rear 13 inches | Aimed Up & Right |
| B6 | Rear 13 inches | Aimed Straight Forward |
| B7 | Forward 13 inches | Aimed Down & Right |
| B8 | Forward 13 inches | Aimed Up & Right |
| B9 | Forward 13 inches | Aimed Straight Forward |

The GDOP analysis evaluates the partial derivatives of the observations of the digital cameras 208-1, 208-2 and 208-3 with respect to the states of the geometric model 500. The states of the geometric model 500 are then determined from the observations. Specifically, the GDOP analysis uses the "Method of Inverse Partials" to calculate a covariance matrix of the states from a covariance matrix of the observations. In this case the observations are the X- and Y-positions of each of the point emitters 520-1 and 520-2 on the image sensors of the three digital cameras 508, resulting in a total of 12 observations. The states are the center coordinates (X0, Y0, Z0) of the baseline of the point emitters 520, the azimuth angle (θ), and the elevation angle (ϕ). All angles are stated in radians. The method of inverse partials states that:

$$\mathrm{cov}(\Delta\bar{x}\Delta\bar{x}^T) = \left[\left(\frac{\partial\bar{F}}{\partial\bar{x}}\right)^T \left[\mathrm{cov}\left(\Delta\bar{\Theta}\Delta\bar{\Theta}^T\right)\right]^{-1}\left(\frac{\partial\bar{F}}{\partial\bar{x}}\right)\right]^{-1}, \quad (1)$$

where $\bar{x}$ is the state vector, $\bar{\Theta}$ is the observation vector, $\bar{\Theta}=\bar{F}(\bar{x})$ is the dependence of the observations on the states, $\mathrm{cov}(\Delta\bar{x}\Delta\bar{x}^T)$ is the covariance matrix of the states, $\mathrm{cov}(\Delta\bar{\Theta}\Delta\bar{\Theta}^T)$ is the covariance matrix of the observations.

One advantage of this method is that for an over-determined solution, it yields the covariances for the least-squares solution, which includes a Kalman filter. Thus, the GDOP analysis uses the same covariance matrix as is used in the Kalman filter within the data fusion processor 412 for solving for the orientations of the weapon given the twelve observations provided by the three images of the two point emitters 442.

Two digital cameras would be sufficient to solve for the five states since two digital cameras would provide eight observations. Using four digital cameras, resulting in sixteen observations, would enable a more accurate and even more robust orientation system than using two or three digital cameras.

Figure 6A:
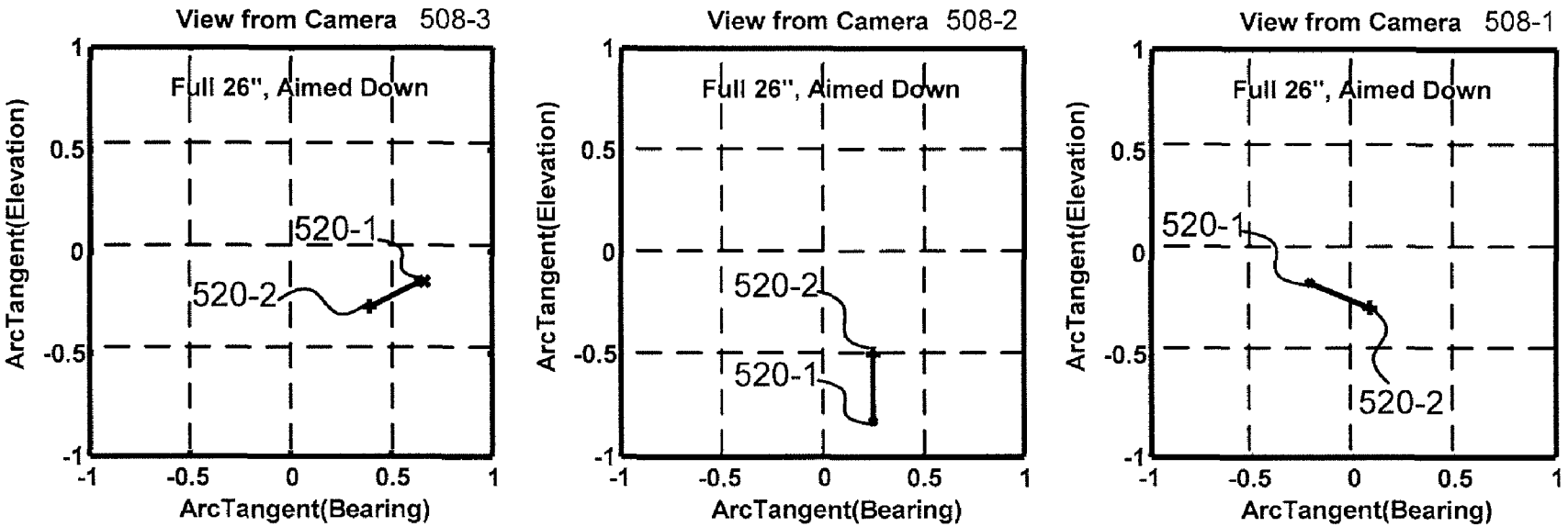
FIGS. 6A and 6B are graphs showing relative locations of point emitters mounted on a weapon as viewed from multiple cameras in an embodiment of a weapon orientation system in accordance with the disclosure.
Figure 6B:
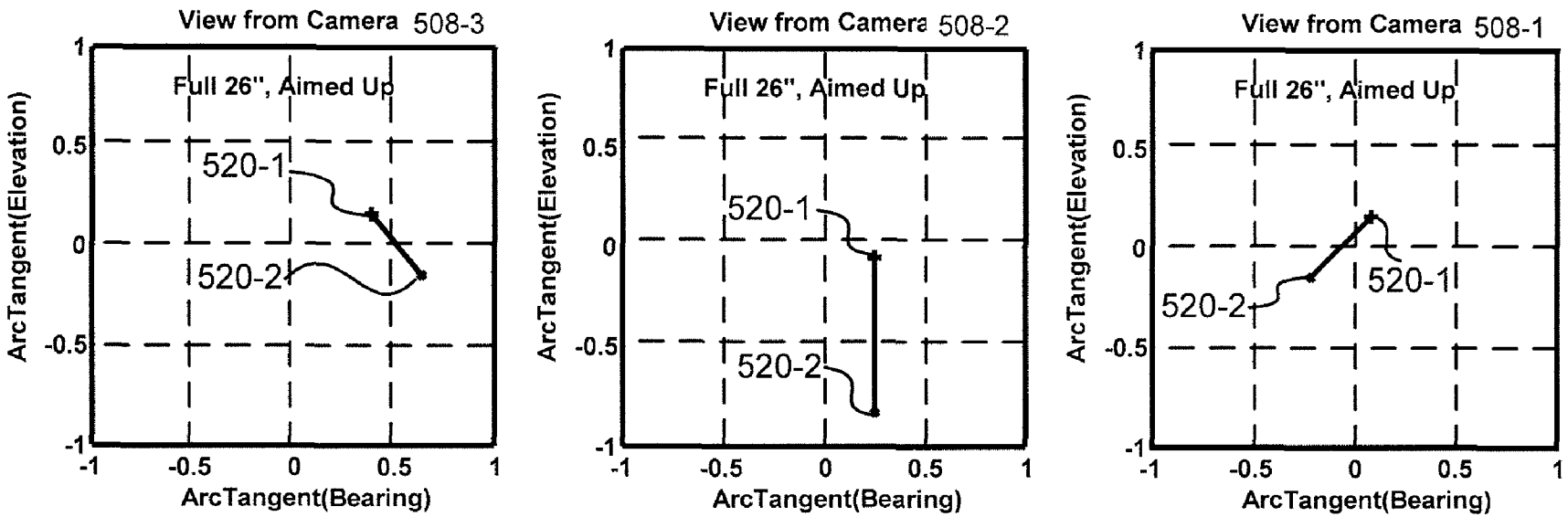

Referring to FIGS. 6A and 6B, illustrations of images captured by the three digital cameras 508 show locations of the aft and fore point emitters 520-1 and 520-2 for the B1 and B2 test cases, respectively. The coordinates of the graphs are arc-tangents of the azimuth and elevation of the point emitters 520-1 and 520-2 relative to the digital cameras 508-1, 508-2 and 508-3. In reference to the actual weapon orientation system 400 of FIG. 4, the image processor 416 of the orientation platform subsystem 410 identifies the locations of the point emitters 520-1 and 520-2 in the images of FIGS. 6A and 6B and provides the coordinates of these locations to the data fusion processor 412. The data fusion processor 412 then calculates the weapon orientation given the twelve (x, y) observations. In some embodiments, the image processor 416 identifies the center most pixel, or fraction of a pixel of the point emitters 520, and forwards these coordinates to the data fusion processor 412.

Referring again to the GDOP analysis, given the 2-D coordinates ($x_1$, $y_1$, $x_2$, $y_2$) of the three images (twelve observations), and the baseline length between the two point emitters (a thirteenth observation), the GDOP analysis solves for the 3-D coordinates (x, y, z) of one of the point emitters 520, and the angle of bearing and the angle of depression/elevation, all with the knowledge of the emitter baseline length. The GDOP analysis then computes the covariances of five states: the x, y, and z coordinates (X0, Y0, Z0) of the of one of the point emitters 520, and the azimuth and elevation of the baseline. This takes into account that the length of the baseline is known, so that only five degrees of freedom exist. The variances of the azimuth and elevation of the baseline are the quantities of interest. The Cartesian coordinates of the location of the point emitter 520 are not of concern in the weapon orientation problem, so only the azimuth and elevation errors are presented in the following results.

The results of the GDOP analysis are shown Table 2. The GDOP numbers shown represent the growth in standard deviation, which varies from 0.98 for the most favorable baseline geometry to 2.25 for the least favorable geometry considered. Further, the GDOP is approximately the same for azimuth and elevation. These factors are more favorable than intuition might suggest. This can probably be attributed to the use of twelve observations to assess five states, a substantial over-determination.

TABLE 2

Results of GDOP Analysis

| | Geometric Dilution of Precision (GDOP) | | | |
|---|---|---|---|---|
| | Variance Growth: | | Std. Dev. Growth: | |
| Baseline Geometry | Azimuth | Elevation | Azimuth | Elevation |
| B1: Full 26", Aimed Down | 0.9968 | 0.8990 | 1.00 | 0.95 |
| B2: Full 26", Aimed Up | 1.0006 | 0.9960 | 1.00 | 0.98 |
| B3: Full 26", Straight Out | 1.0004 | 0.8820 | 1.00 | 0.94 |
| B4: Rear 13", Aimed Down | 2.1191 | 1.9173 | 1.46 | 1.38 |
| B5: Rear 13", Aimed Up | 2.1249 | 2.2228 | 1.46 | 1.49 |
| B6: Rear 13", Straight Out | 2.2402 | 1.8445 | 1.50 | 1.36 |
| B7: Fore 13", Aimed Down | 5.2246 | 4.5948 | 2.29 | 2.14 |
| B8: Fore 13", Aimed Up | 5.2378 | 4.6891 | 2.29 | 2.17 |
| B9: Fore 13", Straight Out | 5.0571 | 4.5408 | 2.25 | 2.13 |

As can be seen from the GDOP results of Table 2, the 26 inch baseline gives more favorable results than either of the 13 inch baselines. Also, the rear 13 inch baseline gives more favorable results than the fore 13 inch baseline. As a conservative estimate, using forward mounting of a shorter 13 inch baseline (test cases B7-B9), the likely GDOP would be 2.0 to 2.5 times. A similar analysis with a four-camera configuration yields a range of GDOP from 1.8 to 2.0 times for the same test cases. To achieve 1 milliradian precision with GDOP of 2.5, the digital cameras 508 should provide 0.4 milliradian precision (1.0 milliradian/2.5=0.4 milliradian). For digital cameras 508 covering approximately ±45° vertically and ±60° horizontally, the angular coverage is about 0.79×1.05 radians. For a 0.4 milliradian resolution, this requires about 2618×1964 pixels, or about 5.1 megapixels, well within the capability of current sensors.

Referring again to the weapon orientation system 400 of FIG. 4, in some circumstances, the image processor 416 could run into problems identifying the locations of the point emitters 442. For example, background images, such as sunlight reflecting off gunmetal surfaces may confuse the image processor 416 to the point where it cannot correctly identify the point emitters 442. Also, in certain geometries, it may be difficult for the image processor 416 to discern which bright image spot is associated with which point emitter 442.

Regarding the problem of confusing background images, the point emitters 442 can be made distinguishable from the background by blinking them off and on. In particular, if the "On" and "Off" cycles are assigned to two different frame scans of the digital cameras 408, and synchronized, then the images of the point emitters 442 are easily distinguished from the background by subtracting the Off cycle image from the On cycle image.

In some embodiments, the point emitters 442 can be controlled by the weapon processor 434. The weapon processor 434 can be configured to control the output on wires to the two point emitters 442, or it can illuminate optical fibers that run to the two reference points. The weapon processor 434 can also use the PAN device integrated in the weapon processor 434, to receive synchronization information over the PAN from the data fusion processor 412.

The point emitter 442 blinking cycle can be synchronized to the digital cameras 408 scan cycle using at least two methods. In either method the On-Off cycle rate and the camera two-frame rate will be nominally the same. In the first method, the data fusion processor 410 sends a synchronizing signal via the PAN to the weapon transmitter 432 of the weapon subsystem 430, so that the blinking of the point emitters 442 are synchronized to the scan rate of the digital cameras 408. If the digital cameras 408 use a scan rate of 30 frames per second, the "On" cycles for one of the point emitters 442 will occur every other scan and provide an angular update at 15 times per second for each of the point emitters 442.

In the second synchronization method the point sources are operated in a blinking cycle of On-On-Off. That is, the point emitters 442 are controlled to emit for two out of every three scans, independently timed. Then the digital cameras capture three scans, such as, for example, an On-On-Off blinking cycle, and if some illumination bleeds into the Off scan, the relative brightness of the spots in the two On scan images will indicate whether the scans are early or late. The data fusion processor 412 can then adjust the blinking cycle to be earlier or later to equalize the spots in the two On scans and minimize the spots in the Off scan. In this second synchronization method, a full update need only occur 10 times per second, but there are really two images that provide spot image positions, for a total of 20 per second. This approach obviates the need to send synchronizing signals from the data fusion processor 412 to the weapon transmitter 432.

Regarding the problem of the image processor 416 being unable to discern which of the point emitters 442 are located at which bright spot in the image, blinking patterns can also be used to solve this problem. There are some unlikely situations where the two point emitters 442 may be ambiguous, that is, not obvious as to which is which. In most instances, if three or more digital cameras 408 are used and three or more have a view of both sources, the ambiguity can be resolved from geometric calculations. However, if only two digital cameras 408 have a clear view, or if for any other reason the two spots on the image become ambiguous, an extension of the blinking patterns discussed above can be used to resolve the ambiguity.

Figure 7:
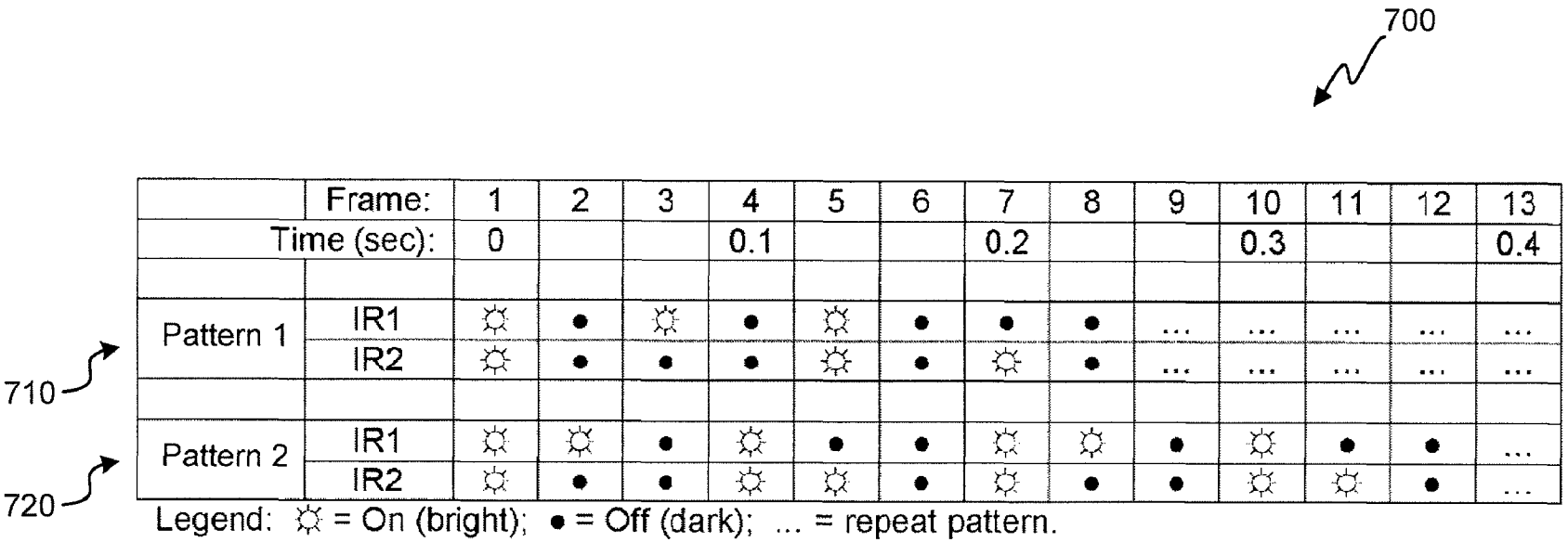
FIG. 7 is a table showing exemplary On-Off timing sequences used to distinguish the spot emitters mounted on a weapon.

Referring to FIG. 7, Table 700 shows two On-Off patterns 710 and 720 which may be used to discern between the two point sources 442. Knowing which frames the first point emitter 442 (IR1 in Table 700) is on and the second point emitter 442 (IR2 in Table 700) is off, the image processor 416 can discern which point emitter 442 is which. The point is that patterns 710 or 720, or any other distinguishable blinking patterns, may be used to clearly identify the two point emitters 442 (IR1 & IR2) from the background or each other. The two point emitters 442 may both be blinked with the same maximum rate pattern (to maximize the measurement rate) using the method discussed above to solve the background problem, except when geometric calculations determine it necessary to distinguish between the two with blinking using patterns such as those in FIG. 7.

Figure 8:
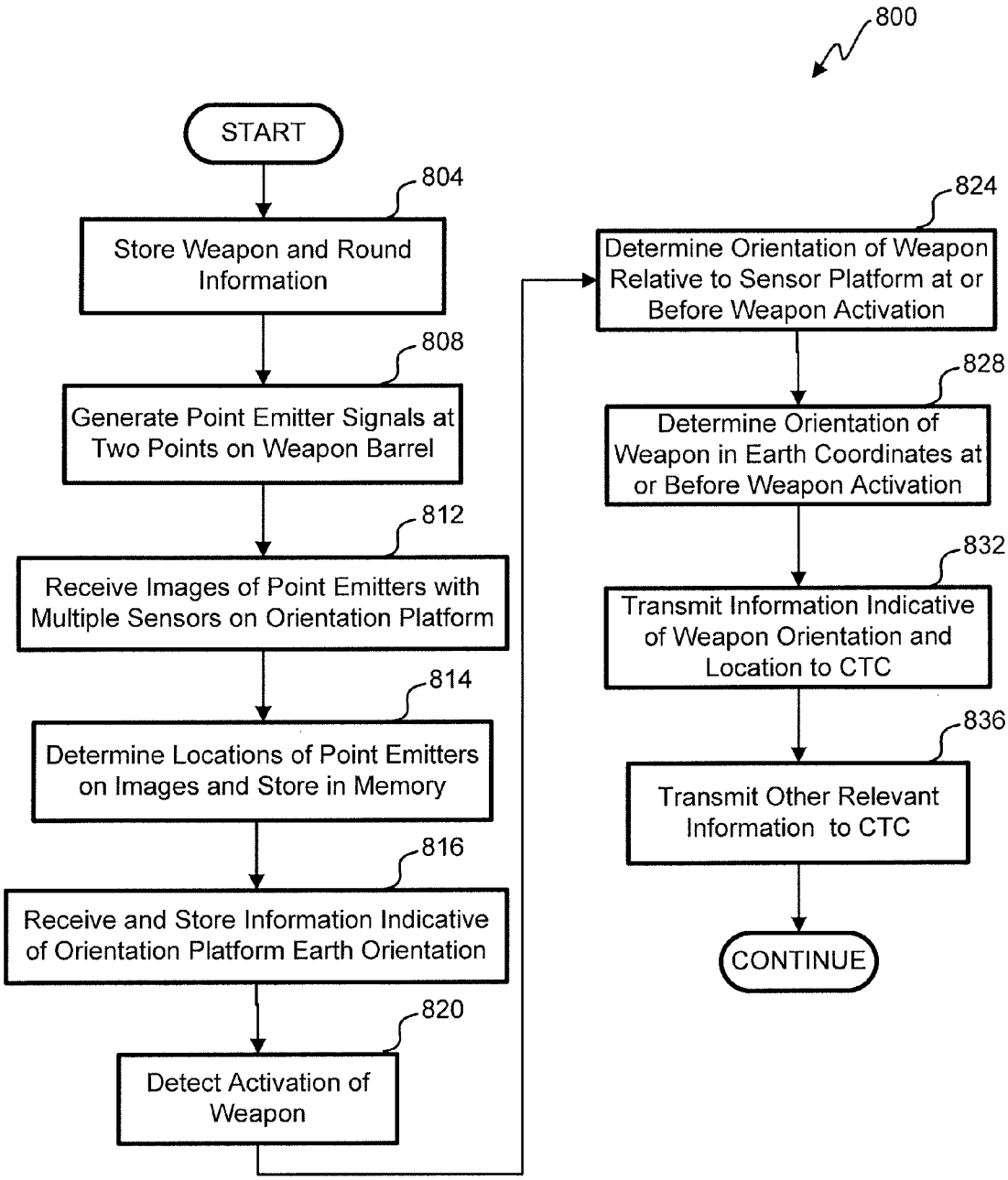
FIG. 8 is a flowchart of an embodiment of steps performed by a weapon orientation system processing event data.

Referring to FIG. 8, a process 800 for determining the orientation of a weapon using the weapon orientation system 400 of FIG. 4 includes the stages shown. The process 800 is exemplary only and not limiting. The process 800 may be altered, e.g., by having stages added, removed, or rearranged.

Process 800 starts at stage 804, where weapon and round information are stored in the orientation platform memory 420. The weapon and round information can be used by the combat training center 112 for purposes of determining hit or miss calculations. Multiple weapons and multiple round type information can be stored to the memory 420. In addition to weapon and round information, information such as soldier identification can also be stored to the memory 420 at the stage 804.

At stage 808, the point emitters 442 are controlled to generate signals from two points located along the barrel of the weapon. The point emitters 442 can generate a constant signal in some embodiments. In other embodiments, the point emitters 442 can be controlled to blink On and Off in predetermined patterns. The patterns can be used by the image processor 416 to distinguish the point emitters 442 from background and/or from each other.

At stage 812, the digital cameras 408 receive the signals from the point emitters 442 and the image processor 416 stores images captured by the digital cameras 408. The images are scanned at predetermined scan rates. At stage 814, the image processor 416 analyzes the images to identify the locations of the point emitters 442. The locations of the point emitters 442 are then stored in the memory 420.

In some embodiments, the locations can be determined from a single image. In other embodiments, the image processor 416 subtracts an image that was captured when one of the point emitters 442 was off from an image that was captured when the one point emitter 442 was on. These embodiments use the images that the image processor 416 previously stored in memory. The previous images can be stored in the orientation platform memory 420, or in other memory associated with the image processor 416. The images are stored with time stamps indicating when the images were captured.

At stage 816, the data fusion processor 412 receives information indicative of the earth orientation of the orientation platform subsystem 410 from the Inertial/magnetic orientation module 418. The orientation information is received periodically at a rate at least as fast as the scan rates of the digital cameras 408. The orientation information is stored in the memory 420. The orientation information is stored with time stamps indicating when the orientation information was captured.

The location information and the earth orientation information stored at stages 814 and 816 is stored periodically. For example, the locations of the point emitters 442 can be stored about every 0.05 seconds, 0.1 seconds, 0.15 seconds, 0.2 seconds etc. Earth orientations can also be stored about every 0.05 seconds, 0.1 seconds, 0.15 seconds, 0.2 seconds etc.

At stage 820, the weapon transmitter 432 detects activation of the weapon. In some embodiments, the weapon transmitter 432 detects when the weapon is activated by detecting a blast and/or a flash of the weapon. In some embodiments, the weapon is loaded with blanks that simulate the firing of actual ammunition without firing a projectile. Upon detection of the activation, the weapon transmitter 432 transmits a notification signal to the data fusion processor 412 via the PAN. The notification signal can be transmitted directly to the data fusion processor 412, or transmitted to the communication subsystem 450 and the forwarded to the data fusion processor 412. The notification signal can include a weapon identifier identifying which weapon was activated if there is more than one weapon connected to the PAN.

Upon receiving the weapon activation notification, the process 800 continues to stage 824, where the data fusion processor 412 determines the orientation of the weapon relative to the orientation platform subsystem 410. The data fusion processor 412 first determines the time of the activation using the time that the activation signal was received and subtracting known delays. The known delays can include sensor processing delays, transmission delays, etc. After determining the time of activation, the data fusion processor 412 obtains the point emitter location information and the earth orientation information from the memory 420. The data fusion processor 412 retrieves the stored information with a time stamp that indicates the data was captured at or before the time that the weapon was activated. In this way, the image and/or orientation information will not be affected by the activation of the weapon.

At stage 828, the data fusion processor 412 determines the orientation of the weapon in earth coordinates based on the point emitter 442 location information and the earth orientation information that was captured at or before activation of the weapon. The data fusion processor uses a Kalman filter associated with the weapon identifier included in the activation signal if more than one weapon is associated with the weapon orientation system 400. In one embodiment, the Kalman filter models 5 states including a three dimensional vector representing a location of a center point between the two point emitters 442 and two angles of rotation of the weapon.

Upon determining the orientation of the weapon at stage 828, the process 800 continues to stage 832 where information indicative of the earth centric weapon orientation is transmitted to an external network such as the data link 108 of the combat training exercise 100. The orientation information is first transmitted from the data fusion processor 412 to the communication interface 452 and then to the data link 108. In some embodiments, the three dimensional vector of the center point between the two point emitters 442 is also transmitted at stage 832. At stage 836, other relevant information such as earth location, activation time, orientation platform velocity, soldier or vehicle identifiers, etc., are transmitted to the combat training center 112 via the data link 108.

Whereas the systems and methods discussed herein relate to determining weapon orientations, the systems and methods could also be used to determine the orientation of any object with respect to another object where the objects have no hard and fast orientation to each other. For example, the systems and methods disclosed herein could be used in some robotic applications.

Embodiments in accordance with the disclosure can be implemented in the form of control logic in software or hardware or a combination of both. The control logic may be stored in an information storage medium as a plurality of instructions adapted to direct an information-processing device to perform a set of steps disclosed in embodiments of the present invention. Based on the disclosure and teachings provided herein, a person of ordinary skill in the art will appreciate other ways and/or methods to implement embodiments in accordance with the disclosure.

Specific details are given in the above description to provide a thorough understanding of the embodiments. However, it is understood that the embodiments may be practiced without these specific details. For example, circuits may be shown in block diagrams in order not to obscure the embodiments in unnecessary detail. In other instances, well-known circuits, processes, algorithms, structures, and techniques may be shown without unnecessary detail in order to avoid obscuring the embodiments.

Implementation of the techniques, blocks, steps, and means described above may be achieved in various ways. For example, these techniques, blocks, steps, and means may be implemented in hardware, software, or a combination thereof. For a hardware implementation, the processing units may be implemented within one or more application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, other electronic units designed to perform the functions described above, and/or a combination thereof.

Also, it is noted that the embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed, but could have additional steps not included in the figure. A process may correspond to a method, a function, a procedure, a subroutine, a subprogram, etc. When a process corresponds to a function, its termination corresponds to a return of the function to the calling function or the main function.

Furthermore, embodiments may be implemented by hardware, software, scripting languages, firmware, middleware, microcode, hardware description languages, and/or any combination thereof. When implemented in software, firmware, middleware, scripting language, and/or microcode, the program code or code segments to perform the necessary tasks may be stored in a machine readable medium such as a storage medium. A code segment or machine-executable instruction may represent a procedure, a function, a subprogram, a program, a routine, a subroutine, a module, a software package, a script, a class, or any combination of instructions, data structures, and/or program statements. A code segment may be coupled to another code segment or a hardware circuit by passing and/or receiving information, data, arguments, parameters, and/or memory contents. Information, arguments, parameters, data, etc. may be passed, forwarded, or transmitted via any suitable means including memory sharing, message passing, token passing, network transmission, etc.

For a firmware and/or software implementation, the methodologies may be implemented with modules (e.g., procedures, functions, and so on) that perform the functions described herein. Any machine-readable medium tangibly embodying instructions may be used in implementing the methodologies described herein. For example, software codes may be stored in a memory. Memory may be implemented within the processor or external to the processor. As used herein the term "memory" refers to any type of long term, short term, volatile, nonvolatile, or other storage medium and is not to be limited to any particular type of memory or number of memories, or type of media upon which memory is stored.

Moreover, as disclosed herein, the term "storage medium" may represent one or more memories for storing data, including read only memory (ROM), random access memory (RAM), magnetic RAM, core memory, magnetic disk storage mediums, optical storage mediums, flash memory devices and/or other machine readable mediums for storing information.

While the principles of the disclosure have been described above in connection with specific apparatuses and methods, it is to be clearly understood that this description is made only by way of example and not as limitation on the scope of the disclosure.

What is claimed is:

1. A weapon orientation measuring device, comprising:

a processor configured to:

receive first location information indicative of locations of a first point and a second point on a weapon, the first and second points being a known distance apart in a direction parallel to a pointing axis of the weapon;

receive second location information indicative of the locations of the first and second points on the weapon;

receive information indicative of a first earth orientation; and determine a second earth orientation corresponding to the weapon based on the first and second location information and the information indicative of the first earth orientation, wherein the first location information represents location relative to a first sensor at a first location and the second location information represents location relative to a second sensor at a second location, the first and second sensors being separated by a given distance.

2. The weapon orientation measuring device of claim 1, further comprising a wireless communication subsystem coupled to the processor and configured to transmit information indicative of the second earth orientation toward a remote location.

3. The weapon orientation measuring device of claim 1, wherein the first and second sensors are first and second digital cameras, and the first and second location information comprise information derived from first and second images of the first and second points on the weapon captured by the first and second digital cameras.

4. The weapon orientation measuring device of claim 3, wherein the processor is further configured to:

periodically store the first and second location information and the first earth orientation information with associated time stamps;

receive an indication of an activation of the weapon; and determine respective ones of the stored first and second location information and the stored earth orientation information that correspond to a time at or prior to a time of the detected activation, based on the respective time stamps; and determine the second earth orientation using the respective ones of the stored information.

5. The weapon orientation measuring device of claim 3, further comprising:

an image processor coupled to the first and second digital cameras and configured to determine the first and second location information by analyzing the first and second images.

6. The weapon orientation measuring device of claim 5, wherein the image processor is further configured to:

analyze images of light emitters positioned at the first and second points on the weapon, and determine the first and second location information by analyzing two images from each of the first and second cameras, wherein the two images include an image captured while the light emitters are emitting light and another image captured while the light emitters are not emitting light.

7. The weapon orientation measuring device of claim 6, wherein the image processor is configured to subtract the images captured while the light emitters are not emitting light from the images captured while the light emitters are emitting light to produce enhanced images an to analyze the enhanced images to determine the first and second location information.

8. The weapon orientation measuring device of claim 1, wherein the first sensor and the second sensor are located on an orientation platform and the processor is further configured to determine a three dimensional location of at least one of the first and second points on the weapon with respect to the orientation platform.

9. A method of determining an orientation of a weapon, the method comprising:

receiving first location information indicative of locations of a first point and a second point on a weapon, the first and second points being a known distance apart in a direction parallel to a pointing axis of the weapon;

receiving second location information indicative of the locations of the first and second points on the weapon;

receiving information indicative of a first earth orientation; and determining a second earth orientation corresponding to the weapon based on the first and second location information and the information indicative of the first earth orientation, wherein the first location information represents location relative to a first sensor at a first location and the second location information represents location relative to a second sensor at a second location, the first and second sensors being separated by a given distance.

10. The method of determining the orientation of the weapon of claim 9, further comprising transmitting information indicative of the second earth orientation toward a remote location.

11. The method of determining the orientation of the weapon of claim 9, wherein the first and second sensors are first and second digital cameras, and the first and second location information comprise information derived from first and second images of the first and second points on the weapon captured by the first and second digital cameras.

12. The method of determining the orientation of the weapon of claim 11, further comprising:

periodically storing the first and second location information and the first earth orientation information with associated time stamps;

receiving an indication of an activation of the weapon; and determining respective ones of the stored first and second location information and the stored earth orientation information that correspond to a time at or prior to a time of the detected activation, based on the respective time stamps; and determining the second earth orientation using the respective ones of the stored information.

13. The method of determining the orientation of the weapon of claim 9, wherein the first sensor and the second sensor are located on an orientation platform, the method further comprising determining a three dimensional location of at least one of the first and second points on the weapon with respect to the orientation platform.

14. A weapon orientation measuring system, comprising:

a first emitter configured to generate a first output signal, the first emitter located at a first point on a weapon;

a second emitter configured to generate a second output signal, the second emitter located at a second point on the weapon, the first and second points being a known distance apart in a direction parallel to a pointing axis of the weapon;

a first sensor configured to receive the first and second output signals and to generate first information indicative of first relative locations of the first and second points on the weapon relative to the first sensor;

a second sensor configured to receive the first and second output signals and to generate second information indicative of second relative locations of the first and second points on the weapon relative to the second sensor, the first and second sensors being separated by a given distance;

an earth orientation device configured to generate information indicative of a first earth orientation; and a communication subsystem configured to transmit weapon orientation information indicative of an earth orientation of the weapon toward a data center remote from the weapon, the weapon orientation information being based on the first and second relative locations and the first earth orientation.

15. The weapon orientation measuring system of claim 14, further comprising:

a processor configured to:

receive the information indicative of the first and the second relative locations;

receive the information indicative of the first earth orientation; and determine a second earth orientation corresponding to the weapon based on the information indicative of the first and second relative locations and the information indicative of the first earth orientation, wherein the weapon orientation information transmitted toward the remote data center comprises information indicative of the determined second earth orientation.

16. The weapon orientation measuring system of claim 14, wherein the weapon orientation information transmitted toward the remote data center comprises information representing the first and second relative locations and the first earth orientation.

17. The weapon orientation measuring system of claim 14, wherein the first and second sensors are first and second digital cameras, and the first and second location information comprise information derived from first and second images of the first and second points on the weapon captured by the first and second digital cameras.

18. The weapon orientation measuring system of claim 15, wherein the processor is further configured to:

periodically store the first and second location information and the first earth orientation information with associated time stamps;

receive an indication of an activation of the weapon; and determine respective ones of the stored first and second location information and the stored earth orientation information that correspond to a time at or prior to a time of the detected activation, based on the respective time stamps; and determine the second earth orientation using the respective ones of the stored information.

19. The weapon orientation measuring system of claim 14, wherein the first and second emitters are infrared light emitters.

20. The weapon orientation measuring system of claim 15, wherein the first sensor and the second sensor are located on an orientation platform and the processor is further configured to determine a three dimensional location of at least one of the first and second points on the weapon with respect to the orientation platform.

* * * * *